US011333031B2

(12) United States Patent
Patel et al.

(10) Patent No.: US 11,333,031 B2
(45) Date of Patent: May 17, 2022

(54) ROTOR BLADE FOR A TURBOMACHINE

(71) Applicant: SAFRAN AIRCRAFT ENGINES, Paris (FR)

(72) Inventors: Vijeay Patel, Moissy Cramayel (FR); Pragash Douglas, Moissy Cramayel (FR); Guillaume Evrard, Moissy Cramayel (FR); Quentin Bruno Guy André Emile Lievoux, Moissy Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/651,052

(22) PCT Filed: Sep. 17, 2018

(86) PCT No.: PCT/FR2018/052273
§ 371 (c)(1),
(2) Date: Mar. 26, 2020

(87) PCT Pub. No.: WO2019/063909
PCT Pub. Date: Apr. 4, 2019

(65) Prior Publication Data

US 2020/0277872 A1 Sep. 3, 2020

(30) Foreign Application Priority Data

Sep. 27, 2017 (FR) ..... 1758929

(51) Int. Cl.
*F01D 11/12* (2006.01)

(52) U.S. Cl.
CPC ..... *F01D 11/122* (2013.01); *F05D 2240/307* (2013.01); *F05D 2240/55* (2013.01)

(58) Field of Classification Search
CPC . F01D 5/20; F01D 5/225; F01D 11/08; F01D 11/12; F01D 11/22; F05D 2240/11; F05D 2240/307
See application file for complete search history.

(56) References Cited

U.S. PATENT DOCUMENTS 3,053,505 A * 9/1962 Welsh ..... F01D 5/225 416/192
5,234,318 A 8/1993 Brandon
(Continued)

FOREIGN PATENT DOCUMENTS

EP 2 551 459 A2 1/2013
FR 2 511 908 A1 3/1983
(Continued)

OTHER PUBLICATIONS

International Search Report as issued in International Patent Application No. PCT/FR2018/052273, dated Dec. 17, 2018.

*Primary Examiner* — Brian P Wolcott
(74) *Attorney, Agent, or Firm* — Pillsbury Winthrop Shaw Pittman LLP

(57) ABSTRACT

A turbomachine rotor blade includes a radially outer end equipped with a heel, the heel being provided with at least one sealing wiper, the or each sealing wiper projecting beyond the heel along a first axis, the first axis being at ±15° with respect to a radial direction, and extending along a second axis, substantially perpendicular to the first axis, between a first upper-surface end and a second lower-surface end, the or each sealing wiper having a first upstream side and a second downstream side as well as a radially outer surface, wherein the or each sealing wiper includes a base attached to the heel and an end piece removably interlocked with the base.

5 Claims, 6 Drawing Sheets

(56) References Cited

U.S. PATENT DOCUMENTS

| | | | | |
|---|---|---|---|---|
| 6,926,495 | B2 * | 8/2005 | Diakunchak | F01D 5/225 415/12 |
| 8,753,093 | B2 * | 6/2014 | Liotta | F01D 5/225 415/173.1 |
| 9,163,519 | B2 * | 10/2015 | Kleinow | F01D 5/225 |
| 9,771,870 | B2 * | 9/2017 | Dierksmeier | F01D 5/147 |
| 10,174,619 | B2 * | 1/2019 | Uskert | F01D 5/147 |
| 10,519,777 | B2 * | 12/2019 | Packer | F01D 5/147 |
| 10,544,698 | B2 * | 1/2020 | Stoyanov | F01D 21/003 |
| 10,550,712 | B2 * | 2/2020 | Durand | F01D 11/122 |
| 10,995,623 | B2 * | 5/2021 | Sippel | F01D 5/20 |
| 2005/0058539 | A1 | 3/2005 | Diakunchak | |
| 2014/0255194 | A1 * | 9/2014 | Jones | F01D 5/225 29/889.7 |

FOREIGN PATENT DOCUMENTS

| | | | |
|---|---|---|---|
| FR | 2 977 909 | A1 | 1/2013 |
| FR | 2 980 234 | A1 | 3/2013 |
| FR | 3 027 622 | A1 | 4/2016 |
| KR | 10-1643900 | B1 | 7/2016 |

* cited by examiner

ROTOR BLADE FOR A TURBOMACHINE

CROSS-REFERENCE TO RELATED APPLICATIONS

This is the U.S. National Stage of PCT/FR2018/052273, filed Sep. 17, 2018, which in turn claims priority to French Application No. 1758929, filed Sep. 27, 2017, the entire contents of all applications are incorporated herein by reference in their entireties.

TECHNICAL FIELD OF THE INVENTION

The present invention relates to a rotor blade for a turbomachine and in particular a low pressure turbine blade of an airplane turbojet or turboprop.

TECHNOLOGICAL BACKGROUND OF THE INVENTION

In turbomachines, play generally exists between the tip of the moving blades and the stator that surrounds them so as to enable the rotation of the blades. In operation, friction between the blades and the stator may arise, notably on account of differential thermal expansions between the rotor and the stator and the mechanical stresses that are exerted on the moving parts of the rotor or on the fixed parts of the associated stator. This friction may lead to damage at the level of the ends of the blades and/or on the surface of the stator.

To reduce this friction, it is known to place blocks of abradable material on the inner surfaces of the stator facing the moving blades, and to provide the moving blades with sealing wipers on their periphery. The sealing wipers of the moving blades are thus configured to engage with the abradable blocks of the inner surfaces of the stator. Such wipers are for example described in the documents FR 2 977 909 and FR 2 980 234.

Under certain conditions, the sealing wipers of the moving blades may come into contact with the blocks of abradable material of the inner surfaces of the stator and consequently wear. During turbomachine maintenance operations, it is wished on the one hand to be able to measure the degree of wear of the wipers in order to know if a replacement or a repair is necessary, and it is wished on the other hand to be able to repair or replace a wiper that is too worn as quickly and efficiently as possible.

It is known to repair sealing wipers by a build-up diffusion brazing method RBD, which is for example described in the document FR 2 511 908. The principle of the RBD method is to deposit and fuse a building-up material on the sealing wiper to repair. The building-up material used in the RBD method is isotropic like the material of the part to repair, which enables a good interface at the join between the part to repair and the building-up material. On the other hand, the RBD method is not controlled in the case where the part to hard face is not made of an isotropic material. The RBD method is thus not suited to all types of materials: the RBD method is notably not suited to a transverse isotropic material having a preferred direction and of which the mechanical behaviour is not identical in all directions of space.

SUMMARY OF THE INVENTION

The invention aims to overcome the drawbacks of the prior art by proposing a turbomachine blade provided with at least one repairable sealing wiper including when said sealing wiper is made of a material of which the mechanical behaviour is not identical in all directions of space.

A first aspect of the invention relates to a turbomachine rotor blade comprising a radially outer end equipped with a heel, the heel being provided with at least one sealing wiper, the or each sealing wiper projecting beyond the heel along a first axis, the first axis being at ±15° with respect to a radial direction, and extending along a second axis, substantially perpendicular to the first axis, between a first upper-surface end and a second lower-surface end, the or each sealing wiper having a first upstream side and a second downstream side as well as a radially outer surface, the or each sealing wiper comprising a base attached to the heel and an end piece removably interlocked with the base.

Within the context of the present invention, the term "radial direction" applies with respect to the engine axis of the turbomachine and the terms "radially outer" or "radially inner" apply with respect to the engine axis of the turbomachine when the blade is mounted in its environment. "A second axis substantially perpendicular to the first axis" is taken to mean a second axis extending perpendicularly to the first axis, to plus or minus 5°. Similarly, "a third axis substantially perpendicular to the first and second axes" is taken to mean a third axis extending perpendicularly to the first and second axes, to plus or minus 5°.

Thanks to the invention, the or each sealing wiper comprises an end piece removably interlocked with a base, which makes it possible to remove the end piece when it is worn and to replace it with a new end piece. It is thus possible to repair such a sealing wiper, including when it is made of a material of which the mechanical behaviour is not identical in all directions of space. Within the context of the present application, "an end piece removably interlocked with a base" is taken to mean the fact that the base remains integral when the end piece is removed. The end piece may notably be tightly mounted in the base, and/or weld points may be formed between the end piece and the base, but the base could receive successively several end pieces without having to be re-machined or re-worked.

Apart from the characteristics that have been mentioned in the previous paragraph, the turbomachine rotor blade according to the first aspect of the invention may have one or more complementary characteristics among the following, considered individually or according to all technically possible combinations thereof:

- The end piece is removably interlocked with the base via a male-female type connection.
- According to first and second embodiments, the end piece has at least one male portion and for the or each male portion of the end piece, the base has a corresponding female portion, the or each male portion of the end piece removably interlocking in said corresponding female portion of the base.
- According to the second embodiment, the end piece has a plurality of male portions and for each male portion of the end piece the base has a corresponding female portion, each male portion of the end piece removably interlocking in said corresponding female portion of the base.
- According to third and fourth embodiments, the base has at least one male portion and for the or each male portion of the base, the end piece has a corresponding female portion, the or each male portion of the base removably interlocking in said corresponding female portion of the end piece.
- According to the fourth embodiment, the base has a plurality of male portions and for each male portion of the base, the end piece has a corresponding female portion, each male portion of the base removably interlocking in said corresponding female portion of the end piece.

A second aspect of the invention relates to a turbomachine rotor blade comprising a radially outer end equipped with a heel, the heel being provided with at least one sealing wiper, the or each sealing wiper projecting beyond the heel along a first axis, the first axis being at ±15° with respect to a radial direction, and extending along a second axis, substantially perpendicular to the first axis, between a first upper-surface end and a second lower-surface end, the or each sealing wiper having a first upstream side and a second downstream side as well as a radially outer surface and comprising a wear indicator.

Thanks to the second aspect of the invention, the or each sealing wiper is equipped with a wear indicator which makes it possible to dispense with the plurality of measurements, potentially long and cumbersome, which were required to know the degree of wear according to the prior art. The degree of wear may be known by a simple visual inspection, simple and rapid, of the wear indicator. Furthermore, this visual inspection may advantageously be carried out by inserting a camera inside the engine to inspect, without having to dismantle the turbine stages of the engine to inspect.

Apart from the characteristics that have been mentioned in the previous paragraph, the turbomachine rotor blade according to the second aspect of the invention may have one or more complementary characteristics among the following, considered individually or according to all technically possible combinations thereof:

According to a first embodiment, the wear indicator is a notch formed in the radially outer surface, the notch having a height measured along the first axis, the notch having a bottom from which an element, of height less than the height of the notch, projects radially. The sealing wiper wears radially. As long the sealing wiper is not worn, the height of the element projecting beyond the bottom of the notch is less than the height of the notch. When the height of the notch becomes equal to the height of the element projecting beyond the bottom of the notch, it is the sign that the sealing wiper must be repaired or replaced.

The notch advantageously has a length measured along the second axis and a width measured along a third axis substantially perpendicular to the first and second axes, the width of the notch being chosen such that the notch does not traverse said sealing wiper. Thus, the notch does not traverse the wiper which makes it possible to preserve the sealing of the wiper.

According to a second embodiment, the wear indicator is an element embedded in the or each sealing wiper in such a way that the element is not apparent from the radially outer surface of said sealing wiper, the element being of a colour different to said sealing wiper.

The sealing wiper wears radially. As long as the sealing wiper is not worn, the element is covered by a radially outer layer of the sealing wiper. When the radially outer layer of the sealing wiper wears, the element becomes apparent on the radially outer surface of the sealing wiper.

According to any of the first and second embodiments, the wear indicator is apparent on the first upstream side and/or on the second downstream side of said sealing wiper. This makes it possible to facilitate the visual detection of wear because the wear indicator, that is to say the notch according to the first embodiment or the embedded element according to the second embodiment, is then visible on the first upstream side or the second downstream side.

In particular, the wear indicator is advantageously arranged on the upstream side of an upstream wiper or on the downstream side of a downstream wiper so as to be visible without having to dismantle the rotor blade, for example by inserting a camera in the rotor. The terms "upstream" and "downstream" are defined with respect to the direction of fluid flow in the turbomachine when the blade is in its machine environment. "Upstream sealing wiper" is taken to mean the sealing wiper which is situated, among the set of sealing wipers, the furthest upstream. Similarly, "downstream sealing wiper" is taken to mean the sealing wiper situated, among the set of sealing wipers, the furthest downstream. In the hypothesis where the heel is only provided with a single sealing wiper, this single wiper may thus both be qualified as "upstream" or "downstream" and the notch may then be equally well arranged on one or the other side of the single wiper.

According to the second embodiment, the element is advantageously apparent on the first upstream side and/or on the second downstream side of said sealing wiper and becomes apparent on the radially outer surface of said sealing wiper after having exceeded a predetermined wear threshold. The predetermined wear threshold corresponds to the thickness of material of the sealing wiper that covers the element radially, along the first axis $\vec{z}$. The element is preferentially covered, along the first axis $\vec{z}$, by a thickness of material of the sealing wiper comprised between 10% and 25% of the height of the wiper.

According to any of the first and second embodiments, the heel is advantageously provided with at least one first upstream sealing wiper comprising a first wear indicator apparent on the first upstream side of said first upstream sealing wiper, and a second downstream sealing wiper comprising a second wear indicator apparent on the second downstream side of said second downstream sealing wiper.

According to any of the first or second embodiments, the or each sealing wiper advantageously has a first portion on the side of its first end and a second portion on the side of its second end, the first portion being wider and higher than the second portion, the height being measured along the first axis and the width being measured along a third axis perpendicular to the first and second axes, and the wear indicator is advantageously arranged at least in the first portion.

A third aspect of the invention relates to a turbomachine rotor comprising a blade according to the first and/or according to the second aspect of the invention.

A fourth aspect of the invention relates to a turbomachine comprising a rotor according to the third aspect of the invention.

The invention and the different applications thereof will be better understood on reading the description that follows and by examining the figures that accompany it.

BRIEF DESCRIPTION OF THE FIGURES

The figures are presented for indicative purposes and in no way limit the invention.

DETAILED DESCRIPTION OF AT LEAST ONE EMBODIMENT OF THE INVENTION

Unless stated otherwise, a same element appearing in the different figures has a single reference.

Figure 1:
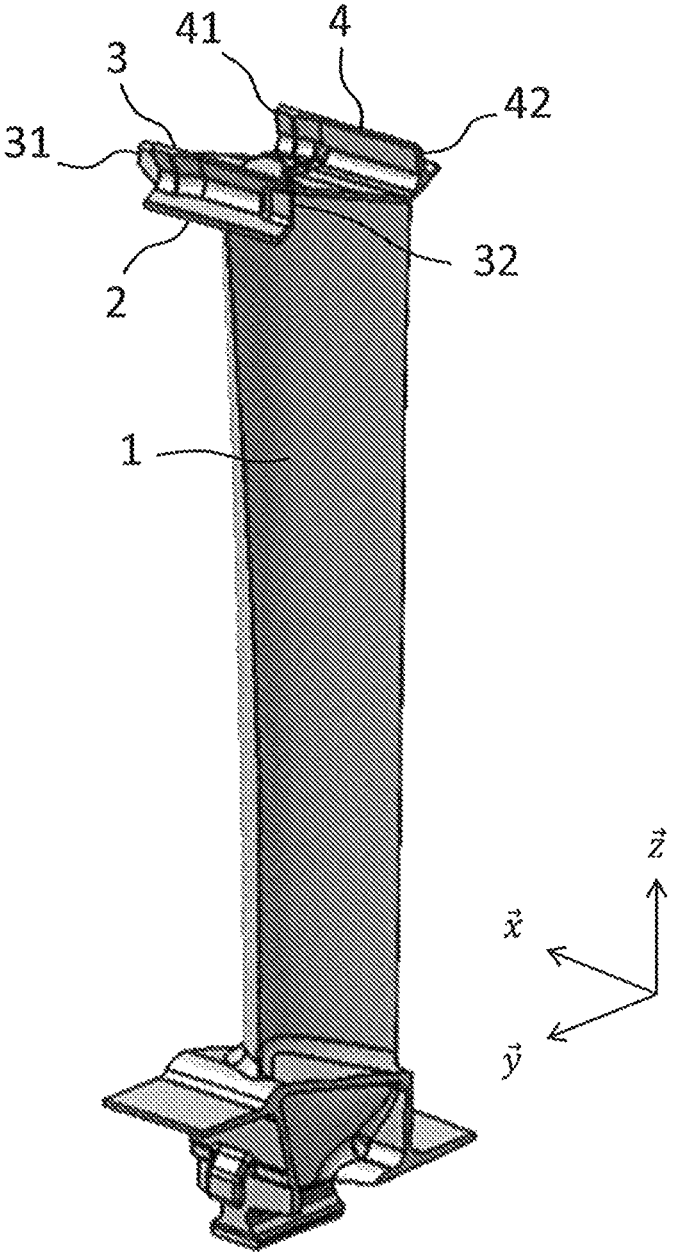
FIG. 1 shows a schematic representation in perspective of a turbomachine rotor blade.

FIG. 1 shows a schematic representation in perspective of a turbomachine rotor blade 1. The blade 1 comprises a radially outer end equipped with a heel 2. Generally speaking, the heel of a blade, also called "plateau", forms a surface substantially perpendicular to the blade; the set of all the contiguous heels forms a sealed crown. The heel 2 is equipped with at least one sealing wiper. In the example of FIG. 1, the heel 2 is equipped with a first upstream sealing wiper 3 and a second downstream sealing wiper 4. When the heel 2 is thus equipped with a plurality of sealing wipers, "upstream sealing wiper" is taken to mean the sealing wiper which is situated, among the plurality of sealing wipers, the furthest upstream. Similarly, "downstream sealing wipe" is taken to mean the sealing wiper situated, among the plurality of sealing wipers, the furthest downstream. Alternatively, the heel 2 could only be provided with a single sealing wiper, for example only the first sealing wiper 3, which could then be qualified both as "upstream" or "downstream". Each sealing wiper 3, 4 projects from the heel 2 along a first axis $\vec{z}$. The first axis $\vec{z}$ extends to plus or minus 15°, preferentially plus or minus 10° and more preferentially plus or minus 5° with respect to a radial direction, the radial direction being defined with respect to the axis of the rotor of the turbomachine. Each sealing wiper 3, 4 extends circumferentially along a second axis $\vec{x}$ substantially perpendicular to the first axis $\vec{z}$, between a first upper-surface end 31, 41 and a second lower-surface end 32, 42. Finally, as is more particularly shown in FIGS. 4*a* and 5, each sealing wiper has a first upstream side 33, 43 and a second downstream side 34, 44, as well as a radially outer surface 35, 45.

A first aspect of the invention will now be described, in relation with FIGS. 2*a*, 2*b*, 3*a* and 3*b*.

According to the first aspect of the invention, the or each sealing wiper 3, 4 comprises a base 7 attached to the heel 2 and an end piece 8 removably interlocked with the base 7.

Figure 2A:
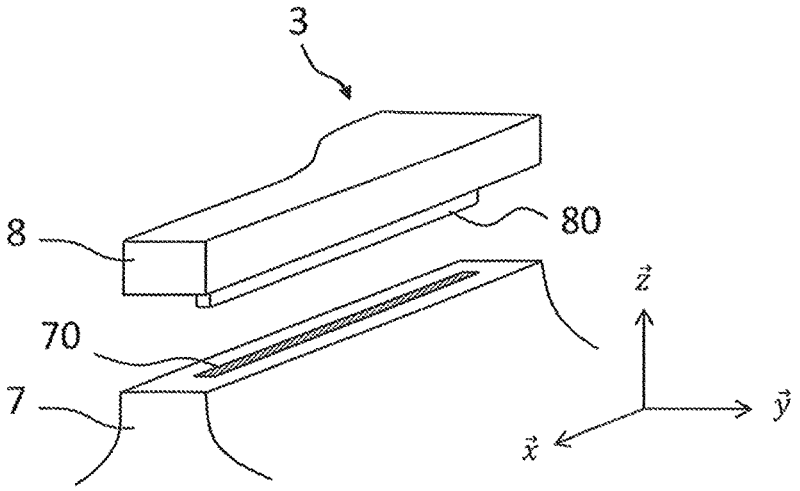
FIG. 2*a* shows a schematic representation in perspective of a sealing wiper according to a first embodiment of a first aspect of the invention.
Figure 2B:
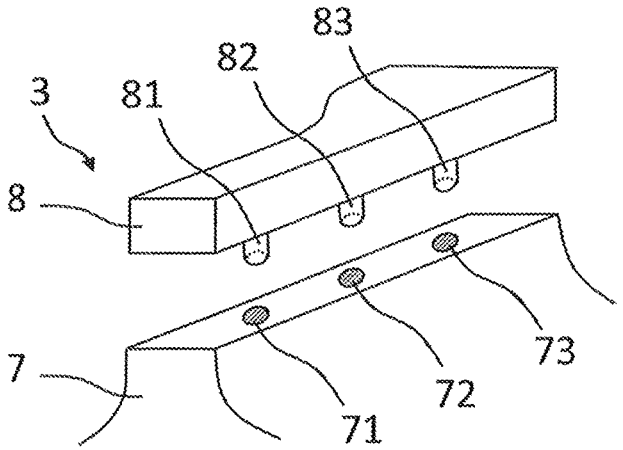
FIG. 2*b* shows a schematic representation in perspective of a sealing wiper according to a second embodiment of the first aspect of the invention.
Figure 2C:
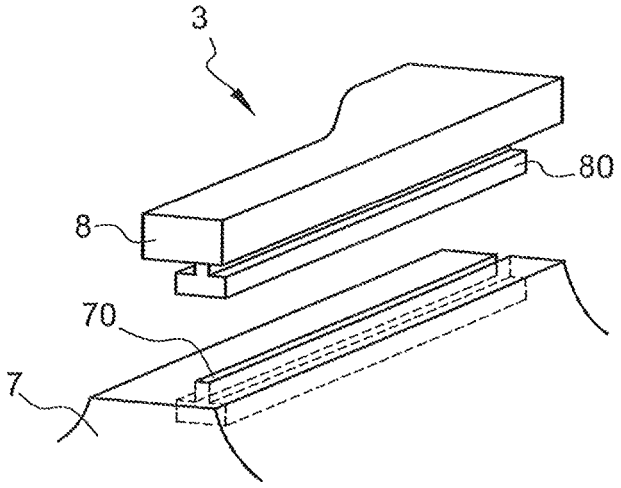
FIG. 2*c* shows a schematic representation in perspective of a sealing wiper according to an alternative of the first embodiment of the first aspect of the invention.

FIG. 2*a* shows a schematic representation in perspective of the first sealing wiper 3 according to a first embodiment of the first aspect of the invention. FIG. 2*b* shows a schematic representation in perspective of the first sealing wiper 3 according to a second embodiment of the first aspect of the invention. FIG. 2*c* shows a schematic representation in perspective of the first sealing wiper 3 according to an alternative of the first embodiment of the invention.

According to the first embodiment of the first aspect of the invention, the end piece 8 has a single male portion 80 and the base 7 has a single female portion 70 corresponding to the male portion 80, the male portion 80 removably interlocking in the female portion 70. The male portion is for example of parallelepiped shape but may alternatively have any other type of shape. In particular, according to the alternative of the first embodiment of the invention, the male portion 80 has an inverted T shape, with a first portion having an essentially radial extension, along the first axis $\vec{z}$, and a second portion having an extension essentially perpendicular to the first portion, along the third axis $\vec{y}$.

According to the second embodiment of the first aspect of the invention, the end piece 8 has a plurality of male portions 81, 82, 83 and the base 7 has, for each male portion of the end piece 8, a corresponding female portion 71, 72, 73, each male portion removably interlocking in its corresponding female portion. Each male portion is for example of cylindrical shape but may alternatively have any other type of shape.

An example of dimensioning, expressed as a function of the total height (along the first axis $\vec{z}$) of sealing wiper and valid both for the first and second embodiments is the following:

- height of the base 7: ⅔±10% of the total height of the sealing wiper;
- depth of the or each female portion 70, 71, 72, 73: ⅓±10% of the total height of the sealing wiper;
- height of the or each male portion 80, 81, 82, 83 projecting beyond the end piece 8: ¼±10% of the total height of the sealing wiper;
- height of the end piece 8 without the or each male portion 80, 81, 82, 83: ⅓±10% of the total height of the sealing wiper.

Figure 3A:
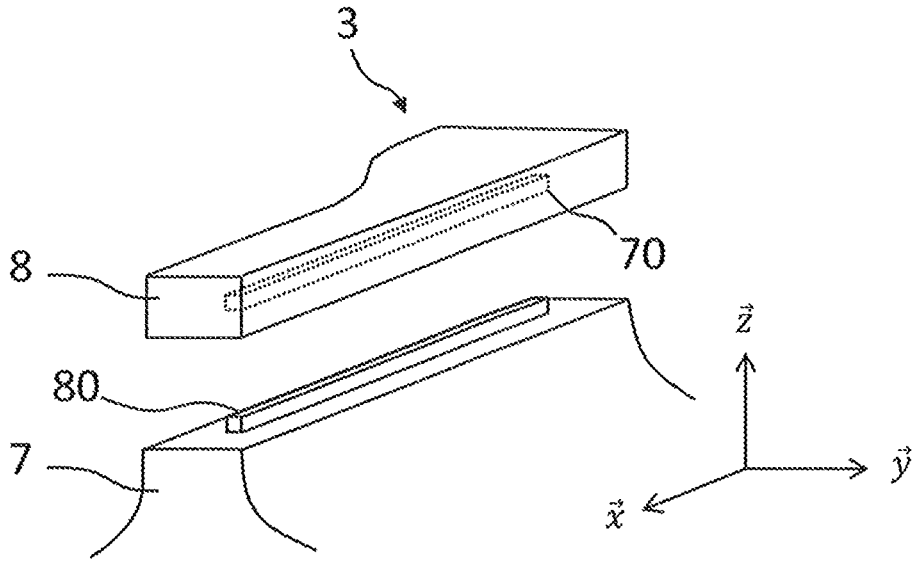
FIG. 3*a* shows a schematic representation in perspective of a sealing wiper according to a third embodiment of the first aspect of the invention.
Figure 3B:
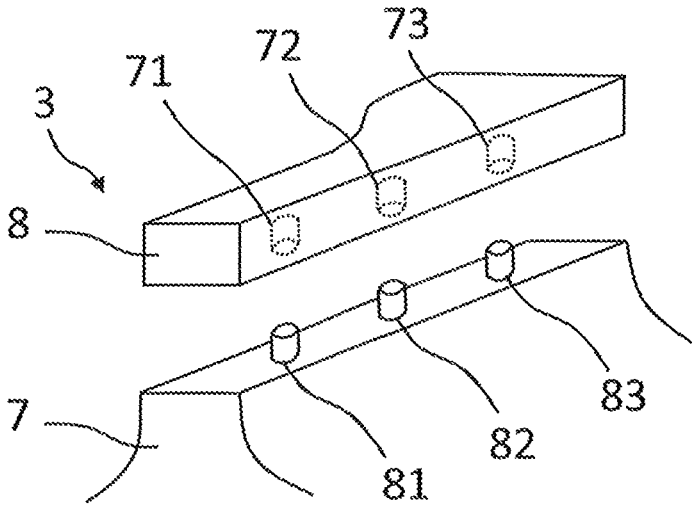
FIG. 3*b* shows a schematic representation in perspective of a sealing wiper according to a fourth embodiment of the first aspect of the invention.

FIG. 3*a* shows a schematic representation in perspective of the first sealing wiper 3 according to a third embodiment of the first aspect of the invention. FIG. 3*b* shows a schematic representation in perspective of the first sealing wiper 3 according to a fourth embodiment of the first aspect of the invention.

According to the third embodiment of the first aspect of the invention, the single male portion 80 projects from the base 7 whereas the single corresponding female portion 70 is arranged in the end piece 8.

According to the fourth embodiment of the first aspect of the invention, the plurality of male portions 81, 82, 83 projects from the base 7 whereas each corresponding female portion 71, 72, 73 is arranged in the end piece 8.

An example of dimensioning, expressed as a function of the total height (along the first axis $\vec{z}$) of sealing wiper and valid for the third and fourth embodiments is the following;

- height of the end piece 8: ⅔±10% of the total height of the sealing wiper;
- depth of the or each female portion 70, 71, 72, 73 of the end piece 8: ⅓±10% of the total height of the sealing wiper;
- height of the or each male portion 80, 81, 82, 83 projecting beyond the base 7: ¼±10% of the total height of the sealing wiper;
- height of the base 7 without the or each male portion 80, 81, 82, 83: ⅓±

10% of the total height of the sealing wiper.

According to each of the first, second, third and fourth embodiments of the first aspect of the invention, as well as according to the alternative of the first embodiment of the first aspect of the invention, the end piece may notably be tightly fitted in the base, and/or weld points may be formed between the end piece and the base in order to retain the end piece radially when the turbomachine is in rotation and when a centrifugal force is exerted thereon. According to the alternative of the first embodiment of the invention, the inverted T shape of the male portion of the end piece makes it possible to retain the end piece radially including in the absence of tight mounting and/or weld points with the base.

A second aspect of the invention will now be described, in relation with FIGS. 4*a*, 4*b*, 5, 6*a*, 6*b* and 6*c*. The second aspect of the invention relates to the problem of the measurement of the degree of wear of wipers in order to know if a replacement or a repair is necessary. At present, to measure the degree of wear of a part, it is known to measure said part before mounting it, then measuring it again during the maintenance operation: the difference between these two measurements is compared to a reference value in order to decide whether the wear is acceptable or not. This measurement may however be carried out in several ways, for example:

- a first way is to measure the height of the considered wiper with respect to the foot of the moving blade;
- a second way is to measure the height of the considered wiper with respect to the heel of the moving blade;
- a third way is to measure, once the moving blades are mounted on the wheel, the inner radius of the wheel at the level of the most upstream wiper and the outer radius at the level of the most downstream wiper, then to work out the average of these two measurements;
- a fourth way is to measure between two adjacent parts on a mounted wheel.

If the measurements before mounting then during maintenance are not carried out in the same way, they are no longer comparable and the measurement of the degree of wear is flawed. If the measurement before mounting has not been carried out, it becomes impossible to measure the degree of wear. Finally, even if the measurements before mounting then after maintenance are indeed carried out and in the same way, this method requires measurement equipment and is quite long to implement because each part must be properly set before being measured and because the number of parts is important.

The second aspect of the invention aims to propose a turbomachine blade provided with at least one sealing wiper of which the degree of wear is measurable in a more reliable and quicker manner than in the prior art.

A first embodiment of a second aspect of the invention will now be described, in relation with FIGS. 4*a*, 4*b* and 5. According to the second aspect of the invention, the or each sealing wiper comprises a wear indicator; according to the first embodiment of the second aspect of the invention, the wear indicator is a geometric indicator, for example a notch. The first sealing wiper 3 according to the first embodiment of the second aspect 30 of the invention is schematically represented in perspective in FIG. 4*a* and according to a side view in FIG. 4*b*. In the case where the heel comprises a plurality of sealing wipers, FIG. 5 shows a schematic representation according to a top view of the first upstream sealing wiper 3 and of the second downstream sealing wiper 4 according to the first embodiment of the second aspect of the invention.

Figure 4A:
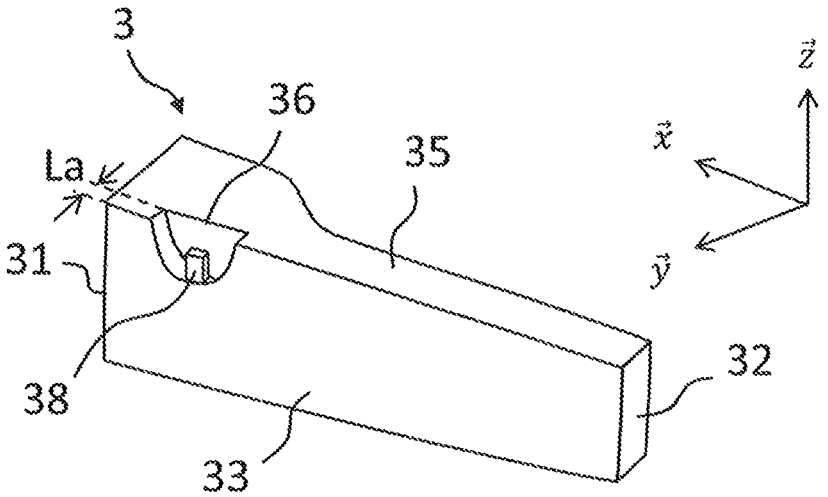
FIG. 4*a* shows a schematic representation in perspective of a sealing wiper according to a first embodiment of a second aspect of the invention.
Figure 4B:
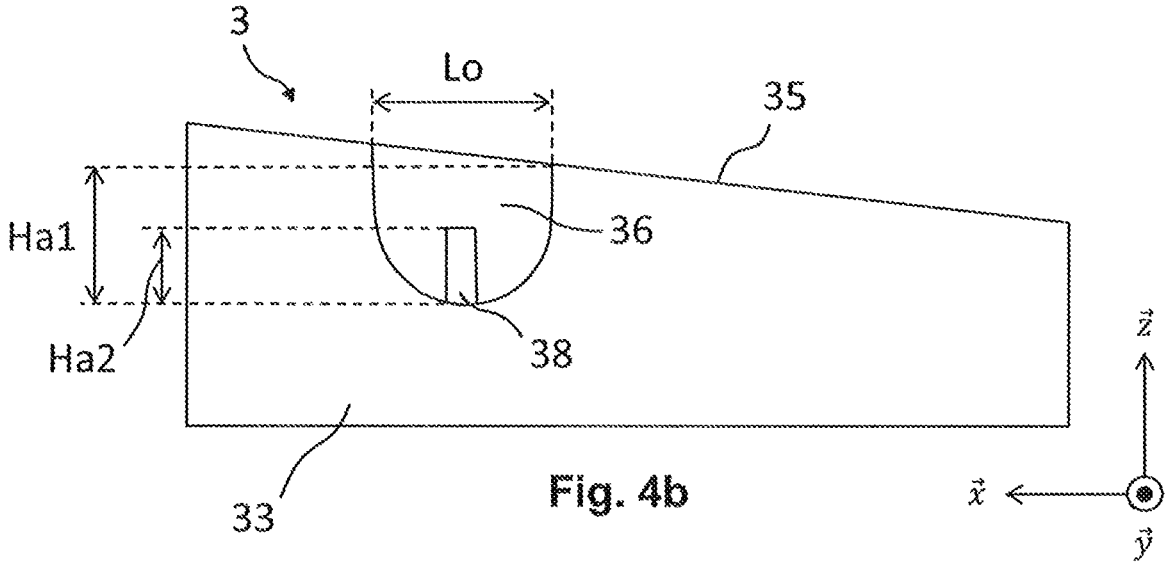
FIG. 4*b* shows a schematic representation according to a side view of the sealing wiper of FIG. 4*a*.

FIGS. 4*a* and 4*b* show that the first sealing wiper 3 comprises a wear indicator in the form of a notch 36 formed in the radially outer surface 35 and in the first upstream side 33 of said first sealing wiper 3. This has the advantage of facilitating the visibility of the wear indicator during an inspection by endoscopy. If the first sealing wiper 3 is the single sealing wiper of the heel 2, the notch 36 may alternatively be formed in the radially outer surface 35 and in the second downstream side 34 of said first sealing wiper 3. The notch 36 has a height Ha1 which is measured along the first axis $\vec{z}$, a length Lo which is measured along the second axis $\vec{x}$ and a width La which is measured along a third axis $\vec{y}$ substantially perpendicular to the first and second axes $\vec{z}$, $\vec{x}$. The height Ha1 is preferentially comprised between 20% and 50% of the height of the sealing wiper 3, measured along the first axis $\vec{z}$. The length Lo is preferentially comprised between 10% and 25% of the length of the sealing wiper 3, measured along the second axis $\vec{x}$, the width La is preferentially comprised between 10% and 33% of the width of the sealing wiper 3, measured along the third axis $\vec{y}$. The notch 36 has a bottom from which an element 38 projects radially. This makes it possible to facilitate the measurement of wear. The element 38 is of height Ha2, measured along the first axis $\vec{z}$, less than the height Ha1 of the notch 36. The height difference between the height Ha1 of the notch 36 and the height Ha2 of the element 38 is preferentially comprised between 0% and 25% of the height of the notch 36. The element 38 may be of width, measured along the third axis $\vec{y}$, equal to or less than the width of the notch 36. The element 38 is typically of length, measured along the second axis $\vec{x}$, less than the length Lo of the notch 36 but may alternatively be of same length as the notch 36 as a function of the shape the notch 36—for example if the notch 36 has a rectangular profile and not a rounded profile.

Figure 5:
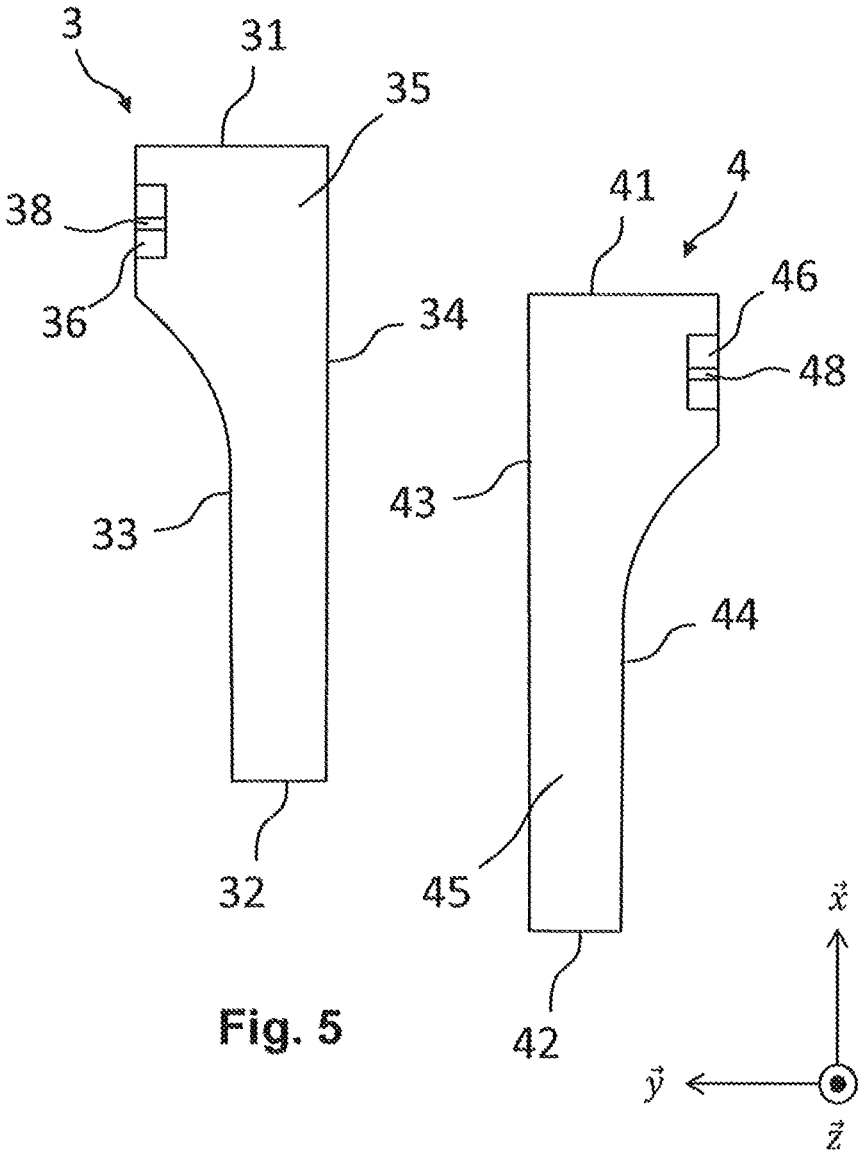
FIG. 5 shows a schematic representation according to a top view of a first upstream sealing wiper and a second downstream sealing wiper according to the first embodiment of the second aspect of the invention.

FIG. 5 shows that the first upstream sealing wiper 3 is equipped with the notch 36 in its radially outer surface 35 and in its first upstream side 33; whereas the second downstream sealing wiper 4 is equipped with a notch 46 in its radially outer surface 45 and in its second downstream side 44. In the same way as the notch 36 of the first sealing wiper 3, the notch 46 of the second sealing wiper 4 has a bottom from which an element 48 projects. The dimensioning of the notch 46 and the element 48 of the second sealing wiper 4 is preferentially done relative to the dimensions of the second sealing wiper 4, in an analogous manner to the dimensioning of the notch 36 and the element 38 of the first sealing wiper 3.

A second embodiment of the second aspect of the invention will now be described in relation with FIGS. 6*a*, 6*b* and 6*c*. According to the second embodiment of the second aspect of the invention, the wear indicator is not a geometric indicator but a colorimetric indicator, for example in the form of an element 5 which is embedded in the or each sealing wiper. The element 5 is of a colour different from the sealing wiper in which it is embedded. The element 5 is for example made of a ceramic material or glass fibre. As long as the sealing wiper is not worn, the element 5 is not apparent from the radially outer surface of said sealing wiper. When the sealing wiper wears radially, the element 5 becomes apparent from the radially outer surface of said sealing wiper. The element 5 is preferentially covered, along the first axis $\vec{z}$, by a thickness of material of the sealing wiper comprised between 10% and 25% of the height of the wiper. Furthermore, the element 5 is preferentially dimensioned in the following manner:

height, measured along the first axis $\vec{z}$, comprised between 10% and 30% of the height of the wiper;

length, along the second axis $\vec{x}$, comprised between 10% and 30% of the length of the wiper;

width, along the third axis $\vec{y}$, comprised between 30% and 100% of the width of the wiper.

Figure 6A:
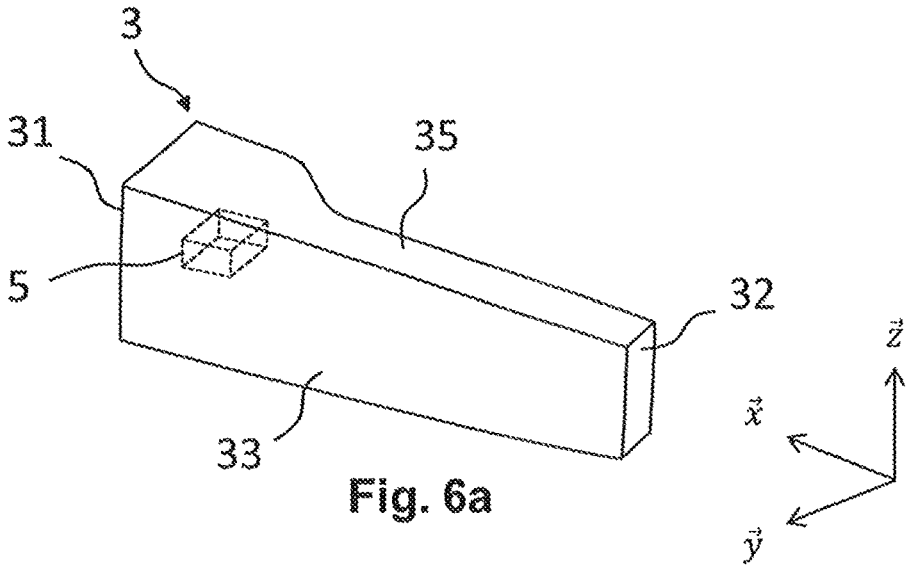
FIG. 6*a* shows a schematic representation in perspective of a sealing wiper according to a first alternative of a second embodiment of the second aspect of the invention.

FIG. 6*a* shows a schematic representation in perspective of the first sealing wiper 3 according to a first alternative of a second embodiment of the second aspect of the invention. FIG. 6*b* shows a schematic representation in perspective of the first sealing wiper 3 according to a second alternative of the second embodiment of the second aspect of the invention. FIG. 6*c* shows a schematic representation in perspective of the first sealing wiper 3 according to a third alternative of the second embodiment of the second aspect of the invention, FIG. 6*a* shows that the element 5 according to the first alternative is entirely embedded in the first sealing wiper 3, in such a way that as long as the first sealing wiper 3 is not worn, the element 5 is not apparent from the radially outer surface 35, and is not apparent either from the first upstream side 33, the second downstream side 34, the first end 31 and the second end 32.

Figure 6B:
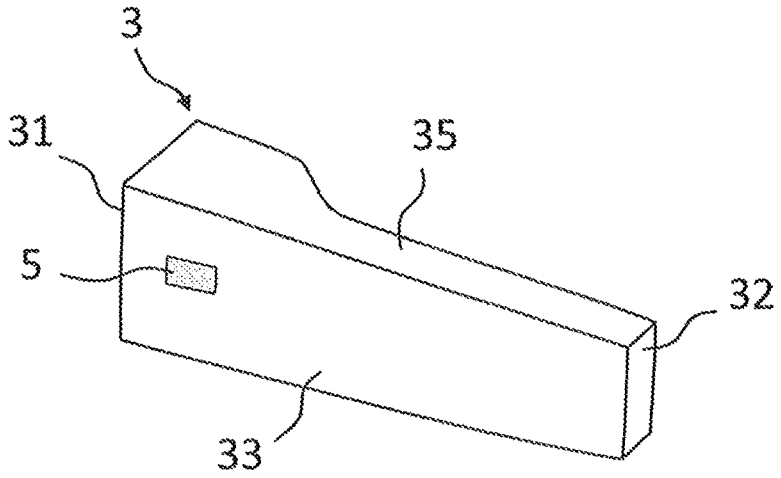
FIG. 6*b* shows a schematic representation in perspective of a sealing wiper according to a second alternative of the second embodiment of the second aspect of the invention.

FIG. 6*b* shows that the element 5 according to the second alternative is partially embedded in the first sealing wiper 3, in such a way that the element 5 is apparent from the first upstream side 33 independently of the wear of the first sealing wiper 3. If the first sealing wiper 3 is the single sealing wiper of the heel 2, the element 5 is equally well apparent from the first upstream side 33 or from the second downstream side 34 or both from the first upstream side 33 and the second downstream side 34. If the heel 2 comprises the first upstream sealing wiper 3 and the second downstream sealing wiper 4, the element 5 of the first upstream sealing wiper 3 is preferentially apparent at least from the first upstream side 33 of the first sealing wiper 3, whereas the element 5 of the second downstream sealing wiper 4 is preferentially apparent at least from the second downstream side 44 of the second sealing wiper 4.

Figure 6C:
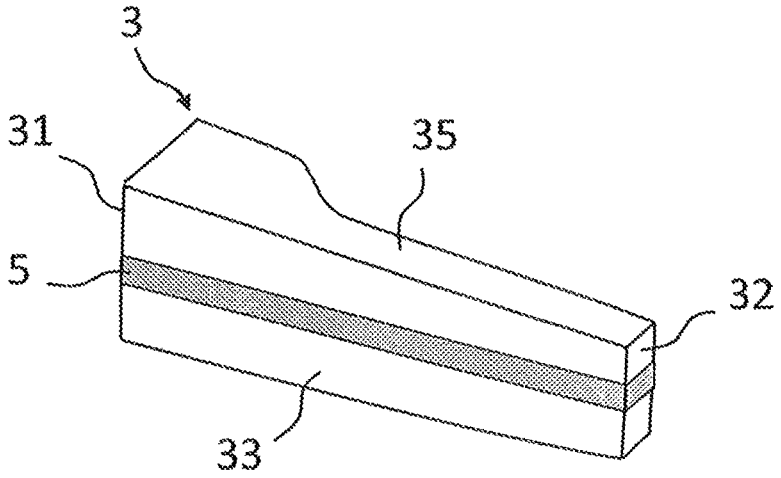
FIG. 6*c* shows a schematic representation in perspective of a sealing wiper according to a third alternative of the second embodiment of the second aspect of the invention.

FIG. 6*c* shows that the element 5 according to the third alternative is partially embedded in the first sealing wiper 3, in such a way that the element 5 is apparent from the first upstream side 33, the second downstream side 34, the first end 31 and the second end 32 independently of the wear of the first sealing wiper 3.

Each sealing wiper 3, 4 represented in FIGS. 4*a*, 4*b*, 5, 6*a*, 6*b* and 6*c* described previously has a first portion on the side of its first end 31, 41 and a second portion on the side of its second end 32, 42, the first portion being wider and higher than the second portion, the height being measured along the first axis $\vec{z}$ and the width being measured along the third axis $\vec{y}$. In this case, the wear indicator in the form of a notch 36, 46 or in the form of an element partially or completely embedded 5 is arranged at least partially in the first portion. Indeed, the first wider and higher portion of each sealing wiper is then the portion intended to attack the abradable material of the inner surface of the stator and which is going essentially to undergo wear. However, the sealing wipers do not necessarily have the form that has been described, with first and second portions and the first portion wider and higher than the second portion; they may for example also be straight, depending on the engine. Generally speaking, the wear indicator according to an aspect of the invention is compatible with all types of wipers.

The first and second aspects of the invention described previously may be implemented independently of each other, or instead in combination with each other in order to propose a sealing wiper comprising a base attached to the heel, an end piece removably interlocked with the base, and a wear indicator arranged on the end piece.

The invention claimed is:

1. A turbomachine rotor blade comprising a radially outer end equipped with a heel, the heel being provided with at least one sealing wiper, the at least one sealing wiper projecting beyond the heel along a first axis, the first axis being at any angle from −15° to +15° with respect to a radial direction, and extending along a second axis, substantially perpendicular to the first axis, between a first upper-surface end and a second lower-surface end, the at least one sealing wiper having a first upstream side and a second downstream side as well as a radially outer surface, wherein the at least one sealing wiper comprises a base attached to the heel and an end piece removably interlocked with the base, the end piece having a plurality of male portions and, for each male portion of the end piece, the base having a corresponding female portion, each male portion of the end piece removably interlocking in said corresponding female portion of the base, wherein each male portion of the end piece is a cylindrical shape extending radially along the first axis when the end piece is interlocked with the base.

2. The turbomachine rotor blade according to claim 1, wherein the at least one sealing wiper comprises a wear indicator.

3. A turbomachine rotor comprising the turbomachine rotor blade according to claim 1.

4. A turbomachine comprising the turbomachine rotor according to claim 3.

5. A turbomachine rotor blade comprising a radially outer end equipped with a heel, the heel being provided with at least one sealing wiper, the at least one sealing wiper projecting beyond the heel along a first axis, the first axis being at any angle from −15° to +15° with respect to a radial direction, and extending along a second axis, substantially perpendicular to the first axis, between a first upper-surface end and a second lower-surface end, the at least one sealing wiper having a first upstream side and a second downstream side as well as a radially outer surface, wherein the at least one sealing wiper comprises a base attached to the heel and an end piece removably interlocked with the base, the end piece having a plurality of male portions and, for each male portion of the end piece, the base having a corresponding female portion, each male portion of the end piece removably interlocking in said corresponding female portion of the base to form a male-female connection between the end piece and the base to prevent rotation of the end piece relative to the base when the end piece is interlocked with the base, wherein each male portion of the end piece is a cylindrical shape extending radially along the first axis when the end piece is interlocked with the base.

* * * * *